US006962404B2

(12) United States Patent
Nunokawa et al.

(10) Patent No.: US 6,962,404 B2
(45) Date of Patent: Nov. 8, 2005

(54) PRINTING METHOD, PRINTING APPARATUS, COMPUTER-READABLE MEDIUM, AND CORRECTION PATTERN

(75) Inventors: Hirokazu Nunokawa, Nagano-ken (JP); Takashi Akase, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

(21) Appl. No.: 10/643,087

(22) Filed: Aug. 19, 2003

(65) Prior Publication Data

US 2004/0095408 A1 May 20, 2004

(30) Foreign Application Priority Data

Aug. 20, 2002 (JP) ..... 2002-239624

(51) Int. Cl.[7] ..... B41J 2/21; B41J 2/205
(52) U.S. Cl. ..... 347/43; 347/15
(58) Field of Search ..... 347/15, 19, 439, 347/12

(56) References Cited

U.S. PATENT DOCUMENTS 6,428,138 B1 * 8/2002 Asauchi et al. ..... 347/15
6,834,936 B2 * 12/2004 Teshigawara et al. ..... 347/43

FOREIGN PATENT DOCUMENTS

| | | |
|---|---|---|
| EP | 1 120 261 A1 | 8/2001 |
| EP | 1 221 371 A1 | 7/2002 |
| EP | 1 221 380 A1 | 7/2002 |
| JP | 5-69625 | 3/1993 |

* cited by examiner

*Primary Examiner*—Thinh Nguyen
(74) *Attorney, Agent, or Firm*—Sughrue Mion, PLLC

(57) ABSTRACT

A printing method comprises: ejecting ink from ink ejecting sections provided in/on a movable print head to form dots; performing at least either printing with a first arrangement using inks arranged according to the first arrangement or printing with a second arrangement using inks arranged according to the second arrangement by changing the arrangement of inks supplied to each of the ink ejecting sections; and printing, with one forward and return movement of the print head, a correction pattern for determining a correction amount to be used for printing with the first arrangement and a correction amount to be used for printing with the second arrangement for correcting a misalignment between a position where dots are formed during a forward pass of the print head and a position where dots are formed during a return pass of the print head that occurs during printing with the first and second arrangements.

10 Claims, 9 Drawing Sheets

PRINTING METHOD, PRINTING APPARATUS, COMPUTER-READABLE MEDIUM, AND CORRECTION PATTERN

CROSS-REFERENCE TO RELATED APPLICATIONS

The present application claims priority upon Japanese Patent Application No. 2002-239624 filed Aug. 20, 2002, which is herein incorporated by reference.

BACKGROUND OF THE INVENTION

1. Field of the Invention

The present invention relates to a printing method, a printing apparatus, a computer-readable medium, and a correction pattern.

2. Description of the Related Art

Some inkjet printers, which perform printing by making a print head eject ink while making it move bidirectionally in a main-scanning direction, have a so-called "bidirectional printing" function which enables printing by ejecting ink during both the forward pass and return pass of the print head.

In performing the bidirectional printing, it is necessary to correct the positions at which dots are formed, in the main-scanning direction, by ink drops ejected during the forward pass and the return pass.

A correction amount for correcting the dot-formation positions may be determined, for example, as follows:

First, while printing during the forward pass, nozzles at the leading edge (in the main-scanning direction) of the print head are used to print, at a predetermined interval in the main-scanning direction, several vertical lines that extend in the sub-scanning direction (sheet-carrying direction). Vertical lines are printed also during the return pass, but when printing the lines during the return pass, different correction amounts are added to each predetermined interval between the lines used in the forward pass, so that the same number of lines are printed but with slightly different intervals between each. Using the pattern printed in this way, the correction amount for bidirectional printing is determined by making a user etc. select a line printed during the forward pass and a line printed during the return pass that look closest to a straight line, and adopting the correction amount that has been added when printing the selected line.

In order to print images having the quality of film-camera photographs, some inkjet printers not only use inks of the four colors—cyan, magenta, yellow, and black—that are necessary for printing in color, but also use additional colors of inks such as light-colored inks (i.e., light cyan ink and light magenta ink) and also dark yellow ink to perform printing with, for example, a total of seven colors of inks. On the other hand, when printing illustrations that only require a limited number of colors for color printing, the light cyan ink, the light magenta ink, and the dark yellow ink are not used because only inks of the four colors, cyan, magenta, yellow, and black, need to be used. In view of such circumstances, some recent inkjet printers—which have seven print heads on which independent cartridges each containing ink of different colors can be detachably mounted—are capable of using ink cartridges of seven colors when printing high-quality images, and also capable of holding ink cartridges each containing cyan ink, magenta ink, and yellow ink, instead of the ink cartridges containing the light cyan ink, the light magenta ink, and the dark yellow ink, and using two print heads for each color for printing when it is desired to print at a higher speed.

When printing is performed using the four colors of inks, ink of the same color is mounted on two print heads. Therefore, as for the two print heads that eject ink of the same color, it becomes necessary to correct the positions at which dots are formed, in the main-scanning direction, by ink drops ejected during the forward pass and the return pass. On the other hand, when printing is performed using the seven colors of inks, it is preferable to correct the positions at which dots are formed, in the main-scanning direction, by ink drops ejected during the forward pass and the return pass for print heads ejecting light-colored inks, particularly, the print head ejecting light cyan ink and the print head ejecting light magenta ink.

Therefore, it is necessary to set independently a correction value for printing with the seven colors and a correction value for printing with the four-colors as the correction values for correcting the positions at which dots are formed in the main-scanning direction by ink drops ejected during the forward pass and the return pass. More specifically, in order to determine the correction value for the seven-color print mode and the correction value for the four-color print mode, it is necessary to print two types of correction patterns using different print heads for each print mode. This requires twice the printing time and ink consumption.

SUMMARY OF THE INVENTION

The present invention has been made in view of the circumstances mentioned above, and an object thereof is to provide a printing method for forming a correction pattern for printing with a first arrangement (a first number of colors) and a correction pattern for printing with a second arrangement (a second number of colors) both at once, a printing apparatus, a correction pattern to be used for the correction, and a computer-readable medium having a program recorded thereon for making a printing apparatus realize a function of printing the correction pattern.

A main invention is a printing method comprising: ejecting ink from ink ejecting sections provided in/on a movable print head to form dots; performing at least either printing with a first arrangement using inks arranged according to the first arrangement or printing with a second arrangement using inks arranged according to the second arrangement by changing the arrangement of inks supplied to each of the ink ejecting sections; and printing, with one forward and return movement of the print head, a correction pattern for determining a correction amount to be used for printing with the first arrangement for correcting a misalignment between a position at which dots are formed during a forward pass of the print head and a position at which dots are formed during a return pass of the print head that occurs during printing with the first arrangement and a correction amount to be used for printing with the second arrangement for correcting a misalignment between a position at which dots are formed during a forward pass of the print head and a position at which dots are formed during a return pass of the print head that occurs during printing with the second arrangement.

Features and objects of the present invention other than the above will become clear by reading the description of the present specification with reference to the accompanying drawings.

BRIEF DESCRIPTION OF THE DRAWINGS

For more complete understanding of the present invention and the advantages thereof, reference is now made to the following description taken in conjunction with the accompanying drawings wherein.

DETAILED DESCRIPTION OF THE INVENTION

Figure 1:
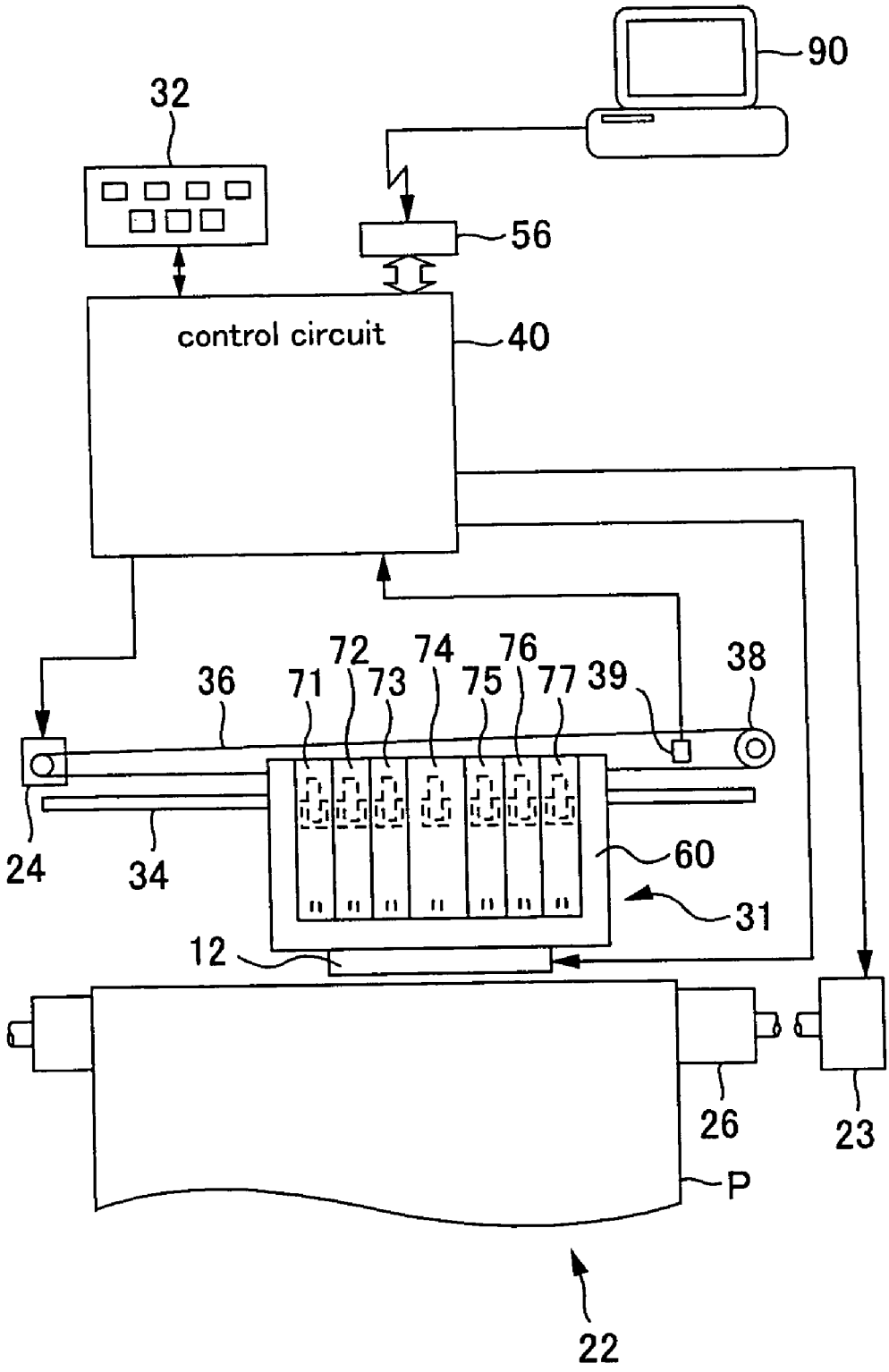
FIG. 1 is a diagram schematically showing the configuration of an inkjet printer according to an embodiment of the present invention.

At least the following matters will be made clear by the explanation in the present specification and the description of the accompanying drawings.

An aspect of the present invention is a printing method comprising: ejecting ink from ink ejecting sections provided in/on a movable print head to form dots; performing at least either printing with a first arrangement using inks arranged according to the first arrangement or printing with a second arrangement using inks arranged according to the second arrangement by changing the arrangement of inks supplied to each of the ink ejecting sections; and printing, with one forward and return movement of the print head, a correction pattern for determining a correction amount to be used for printing with the first arrangement for correcting a misalignment between a position at which dots are formed during a forward pass of the print head and a position at which dots are formed during a return pass of the print head that occurs during printing with the first arrangement and a correction amount to be used for printing with the second arrangement for correcting a misalignment between a position at which dots are formed during a forward pass of the print head and a position at which dots are formed during a return pass of the print head that occurs during printing with the second arrangement.

According to such a method, it is possible to print a correction pattern for determining a correction amount to be used for printing with the first arrangement and a correction amount to be used for printing with the second arrangement with one forward and return movement of the print head. Therefore, it becomes possible to print a correction pattern for determining the correction values for printing with the first arrangement and for printing with the second arrangement in a short amount of time.

Further, since it is possible to determine the correction amounts to be used for two types of printing with one correction pattern, it becomes possible to prevent waste of ink, paper, etc.

It is preferable that in the printing method, inks of a first number of colors are used during printing with the first arrangement; inks of a second number of colors are used during printing with the second arrangement; at least either printing with the first number of colors using the inks of the first number of colors or printing with the second number of colors using the inks of the second number of colors is performed by changing the number of colors of inks supplied on a color-by-color basis to each of the ink ejecting sections; and a correction pattern for determining a correction amount to be used for printing with the first number of colors for correcting a misalignment between a position at which dots are formed during a forward pass of the print head and a position at which dots are formed during a return pass of the print head that occurs during printing with the first number of colors and a correction amount to be used for printing with the second number of colors for correcting a misalignment between a position at which dots are formed during a forward pass of the print head and a position at which dots are formed during a return pass of the print head that occurs during printing with the second number of colors is printed with one forward and return movement of the print head.

Here, the term "number of colors" means a number of different colors. The term "different colors" not only includes colors that are different in hue, but also includes colors with the same hue but in which color saturation and/or lightness of color is intentionally changed. For example, black and light black, or yellow and dark yellow, are "different colors", and the "number of colors" in these cases is "2".

It is preferable that in the printing method, the correction pattern is printed by forming a first sub-pattern during the forward pass of the print head and a second sub-pattern and a third sub-pattern during the return pass of the print head by ejecting ink from different ones of the ink ejecting sections; a sub-pattern pair consisting of the first sub-pattern and one of either the second sub-pattern or the third sub-pattern is taken as the correction pattern for determining the correction amount to be used for printing with the first number of colors; and a sub-pattern pair consisting of the first sub-pattern and the other one of the second sub-pattern or the third sub-pattern is taken as the correction pattern for determining the correction amount to be used for printing with the second number of colors.

According to such a method, it is possible to form two sub-pattern pairs in a correction pattern that is formed by printing with one forward and return movement of the print head, and it becomes possible to determine the correction amount for printing with the first number of colors and the correction amount for printing with the second number of colors using each of these sub-pattern pairs.

It is preferable that in the printing method, each of the ink ejecting sections has ink ejecting points that are arranged in a row in a direction perpendicular to the direction of movement of the print head; the first sub-pattern is formed during the forward pass by ejecting ink from ones of the ink ejecting points that are arranged in a central region of the one of the ink ejecting sections used for forming the first sub-pattern; the second sub-pattern is formed during the return pass by ejecting ink from ones of the ink ejecting points that are arranged in a region on one end of the one of the ink ejecting sections used for forming the second sub-pattern; and the third sub-pattern is formed during the return pass by ejecting ink from ones of the ink ejecting points that are arranged in a region on the other end of the one of the ink ejecting sections used for forming the third sub-pattern.

According to such a method, since the central region of an ink ejecting section is used during the forward pass and opposing end regions of ink ejecting sections are used during the return pass, it becomes possible to form one sub-pattern pair with one of the end regions and the central region and to form the other sub-pattern pair with the other end region and the central region. Therefore, it becomes possible to form two sub-pattern pairs within a range in which one ink ejecting section can eject ink, and therefore, it becomes possible to prevent waste of, for example, ink and paper.

Further, only three sub-patterns are necessary for the two sub-pattern pairs, since the pairs share the first sub-pattern formed during the forward pass. Since it is not necessary to form four sub-patterns for the two sub-pattern pairs, it becomes possible to keep the length of each sub-pattern sufficiently long, even within the limited range available for one ink ejecting section. This makes it possible to form a correction pattern that can be easily confirmed with the eye when determining the correction amounts.

It is preferable that in the printing method, printing with the first number of colors is performed by printing using at least light magenta ink and light cyan ink; and the ink ejecting sections used for printing the correction pattern is an ink ejecting section used for ejecting the light magenta ink during printing with the first number of colors and an ink ejecting section used for ejecting the light cyan ink during printing with the first number of colors.

According to such a method, it becomes possible to print a correction pattern for determining the correction amount for correcting a misalignment between the dot-formation positions of the ink ejecting section for ejecting light magenta ink and the ink ejecting section for ejecting light cyan ink when printing with the first number of colors. Further, by using the correction amount determined using this correction pattern, it becomes possible to obtain high-quality images by printing with the first number of colors.

It is preferable that in the printing method, printing with the second number of colors is performed using at least, among the ink ejecting sections, two of the ink ejecting sections for ejecting magenta ink and two of the ink ejecting sections for ejecting cyan ink; and the ink ejecting sections used for printing the correction pattern are either the two ink ejecting sections for ejecting the magenta ink or the two ink ejecting sections for ejecting the cyan ink.

According to such a method, it becomes possible to print a correction pattern for determining the correction amount for correcting a misalignment between the dot-formation positions of two ink ejecting sections that eject ink of the same color when printing with the second number of colors. Therefore, it becomes possible to obtain satisfactory images when printing with the second number of colors by correcting the misalignment between the positions at which dots are formed with ink of the same color.

Another aspect of the present invention is a printing method comprising: ejecting ink from ink ejecting sections provided in/on a movable print head to form dots; performing at least either printing with a first number of colors using inks of the first number of colors or printing with a second number of colors using inks of the second number of colors by changing the number of colors of inks supplied on a color-by-color basis to each of the ink ejecting sections; and printing, with one forward and return movement of the print head, a correction pattern for determining a correction amount to be used for printing with the first number of colors for correcting a misalignment between a position at which dots are formed during a forward pass of the print head and a position at which dots are formed during a return pass of the print head that occurs during printing with the first number of colors and a correction amount to be used for printing with the second number of colors for correcting a misalignment between a position at which dots are formed during a forward pass of the print head and a position at which dots are formed during a return pass of the print head that occurs during printing with the second number of colors, wherein: each of the ink ejecting sections has ink ejecting points that are arranged in a row in a direction perpendicular to the direction of movement of the print head; the correction pattern is made of a first sub-pattern formed during the forward pass of the print head by ejecting ink from ones of the ink ejecting points that are arranged in a central region of the one of the ink ejecting sections used for forming the first sub-pattern, a second sub-pattern formed during the return pass of the print head by ejecting ink from ones of the ink ejecting points that are arranged in a region on one end of the one of the ink ejecting sections used for forming the second sub-pattern, and a third sub-pattern formed during the return pass of the print head by ejecting ink from ones of the ink ejecting points that are arranged in a region on the other end of the one of the ink ejecting sections used for forming the third sub-pattern by using different ones of the ink ejecting sections; the correction pattern for determining the correction amount to be used for printing with the first number of colors is a sub-pattern pair consisting of the first sub-pattern and one of either the second sub-pattern or the third sub-pattern; the correction pattern for determining the correction amount to be used for printing with the second number of colors is a sub-pattern pair consisting of the first sub-pattern and the other one of the second sub-pattern or the third sub-pattern; printing with the first number of colors is performed by printing using at least light magenta ink and light cyan ink; the ink ejecting sections used for printing the correction pattern is an ink ejecting section used for ejecting the light magenta ink during printing with the first number of colors and an ink ejecting section used for ejecting the light cyan ink during printing with the first number of colors; printing with the second number of colors is performed using at least, among the ink ejecting sections, two of the ink ejecting sections for ejecting magenta ink and two of the ink ejecting sections for ejecting cyan ink; and the ink ejecting sections used for printing the correction pattern are either the two ink ejecting sections for ejecting the magenta ink or the two ink ejecting sections for ejecting the cyan ink.

According to such a method, it is possible to print a correction pattern for determining a correction amount to be used for printing with the first number of colors and a correction amount to be used for printing with the second number of colors with one forward and return movement of the print head. Therefore, it becomes possible to shorten the amount of time for printing the correction pattern. Further, it becomes possible to prevent waste of, for example, ink and paper used for printing the correction pattern.

Another aspect of the present invention is a printing apparatus comprising: a movable print head having ink ejecting sections for ejecting ink to form dots, wherein the printing apparatus: is capable of performing at least either printing with a first arrangement using inks arranged according to the first arrangement or printing with a second arrangement using inks arranged according to the second arrangement by changing the arrangement of inks supplied to each of the ink ejecting sections; and prints, with one forward and return movement of the print head, a correction pattern for determining a correction amount to be used for printing with the first arrangement for correcting a misalignment between a position at which dots are formed during a forward pass of the print head and a position at which dots are formed during a return pass of the print head that occurs during printing with the first arrangement and a correction amount to be used for printing with the second arrangement for correcting a misalignment between a position at which dots are formed during a forward pass of the print head and a position at which dots are formed during a return pass of the print head that occurs during printing with the second arrangement.

Another aspect of the present invention is a computer-readable storage medium having a program recorded thereon, the program making a printing apparatus that has a movable print head having ink ejecting sections for ejecting ink to form dots and that is capable of performing at least either printing with a first arrangement using inks arranged according to the first arrangement or printing with a second arrangement using inks arranged according to the second arrangement by changing the arrangement of inks supplied to each of the ink ejecting sections, and printing a correction pattern for determining a correction amount to be used for printing with the first arrangement for correcting a misalignment between a position at which dots are formed during a forward pass of the print head and a position at which dots are formed during a return pass of the print head that occurs during printing with the first arrangement and a correction amount to be used for printing with the second arrangement for correcting a misalignment between a position at which dots are formed during a forward pass of the print head and a position at which dots are formed during a return pass of the print head that occurs during printing with the second arrangement function to print the correction pattern with one forward and return movement of the print head.

Another aspect of the present invention is a correction pattern for use with a printing apparatus, the printing apparatus being capable of performing at least either printing with a first arrangement using inks arranged according to the first arrangement or printing with a second arrangement using inks arranged according to the second arrangement by changing the arrangement of inks supplied to each of a plurality of ink ejecting sections provided in/on a movable print head and for ejecting ink to form dots, each of the ink ejecting sections having ink ejecting points that are arranged in a row in a direction perpendicular to the direction of movement of the print head, the correction pattern being used for determining a correction amount to be used for printing with the first arrangement for correcting a misalignment between a position at which dots are formed during a forward pass of the print head and a position at which dots are formed during a return pass of the print head that occurs during printing with the first arrangement and a correction amount to be used for printing with the second arrangement for correcting a misalignment between a position at which dots are formed during a forward pass of the print head and a position at which dots are formed during a return pass of the print head that occurs during printing with the second arrangement, the correction pattern comprising: a first sub-pattern formed during the forward pass of the print head and a second sub-pattern and a third sub-pattern formed during the return pass of the print head, wherein: the correction amount to be used for printing with the first arrangement is determined based on a sub-pattern pair consisting of the first sub-pattern and one of either the second sub-pattern or the third sub-pattern; and the correction amount to be used for printing with the second arrangement is determined based on a sub-pattern pair consisting of the first sub-pattern and the other one of the second sub-pattern or the third sub-pattern.

According to such a correction pattern, it becomes possible to determine a correction amount to be used for printing with the first arrangement and a correction amount to be used for printing with the second arrangement by means of a single correction pattern printed with one forward and return movement of the print head.

===Overview of Printing Apparatus===

First, an overview of a printing apparatus will be described below with reference to FIG. 1 and FIG. 2.

FIG. 1 is a schematic structural diagram of a printing system including an inkjet printer 22. FIG. 2 is a block diagram showing a configuration of the printer 22, centering on a control circuit 40.

The printer 22 has a sub-scanning mechanism for carrying a print sheet P using a paper feed motor 23, and a main-scanning mechanism for making a carriage 31 move back and forth in the axial direction of a platen 26 using a carriage motor 24. The direction in which the print sheet P is fed by the sub-scanning mechanism is called herein the "sub-scanning direction", and the direction in which the carriage 31 is moved by the main-scanning mechanism is called herein the "main-scanning direction".

The printer 22 also has: a print head unit 60 that is mounted on the carriage 31 and that has a print head 12; a head drive mechanism that drives the print head unit 60 and controls ink ejection and dot formation; and a control circuit 40 that manages and controls exchanging of signals among the paper feed motor 23, the carriage motor 24, the print head unit 60, and an operation panel 32.

The control circuit 40 is connected to a computer 90 via a connector 56. The computer 90 has installed a driver for the printer 22 and serves as a user interface for accepting user commands that are input through operation of input means such as a keyboard and a mouse and for presenting to the user various kinds of information about the printer 22 by displaying a screen on a display.

The sub-scanning mechanism for carrying the print sheet P has a gear train (not shown) for transmitting the rotation of the paper feed motor 23 to the platen 26 and a print-sheet carrying roller (not shown).

The main-scanning mechanism for making the carriage 31 move back and forth has: a slide shaft 34 that is bridged over the platen 26 in a direction parallel to the axis of the platen 26 and that slidably holds the carriage 31; a pulley 38 between which and the carriage motor 24 is stretched an endless drive belt 36; and a position detection sensor 39 for detecting the home position of the carriage 31.

Figure 2:
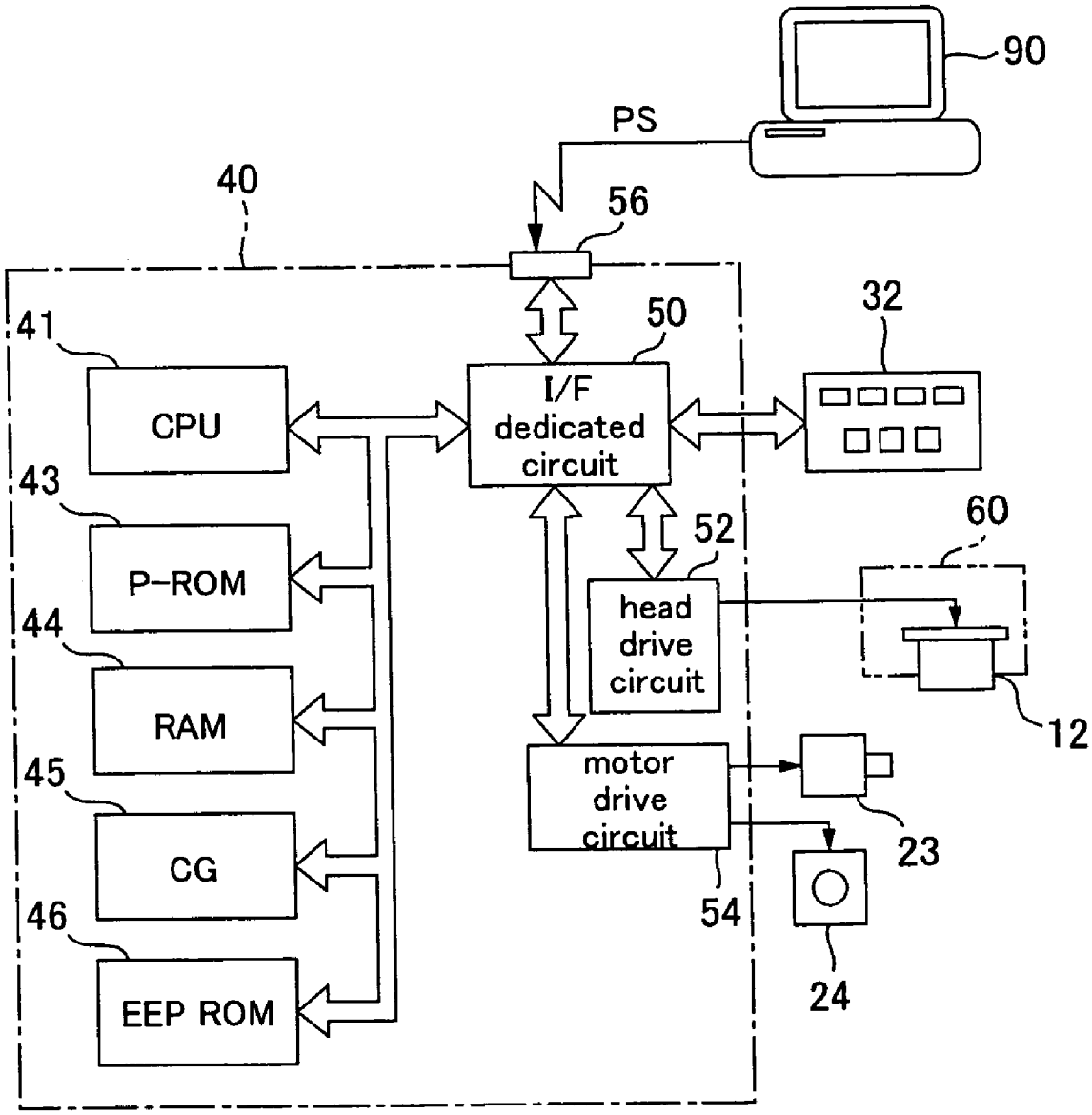
FIG. 2 is a block diagram showing the configuration of the printer, centering on a control circuit.

As shown in FIG. 2, the control circuit 40 is configured as an arithmetic logic circuit having a CPU 41, a programmable ROM (PROM) 43, a RAM 44, a character generator (CG) 45 storing dot matrix information about characters (letters), and an EEPROM 46.

The control circuit 40 further includes: an I/F dedicated circuit 50 specifically designed to serve as an interface (I/F) between, for example, external motors; a head drive circuit 52 that is connected to the I/F dedicated circuit 50 and makes the print head unit 60 drive to eject ink; and a motor drive circuit 54 for driving the paper feed motor 23 and the carriage motor 24.

The I/F dedicated circuit 50 has inside a parallel interface circuit and is capable of receiving print signals PS supplied from the computer 90 via the connector 56.

===Configuration of Print Head===

Figure 3A:
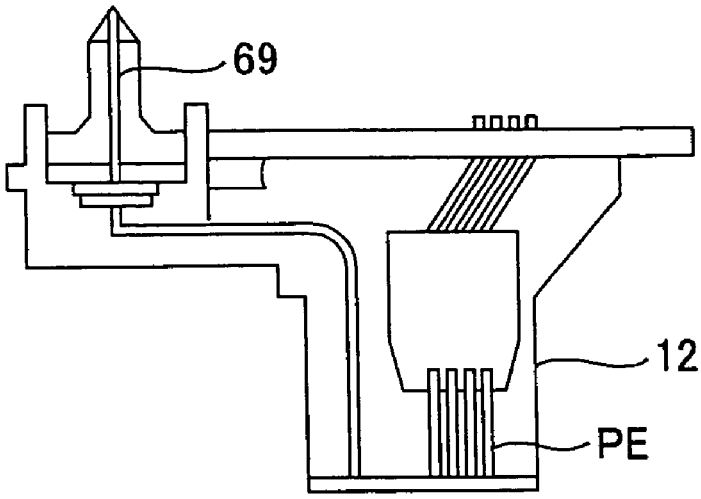
FIG. 3A and FIG. 3B are diagrams schematically showing the configuration of the inside of a print head.
Figure 3B:
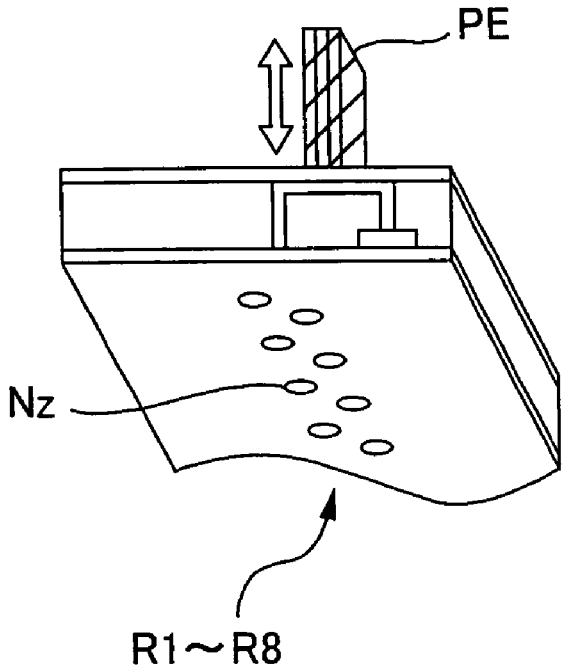
Figure 4A:
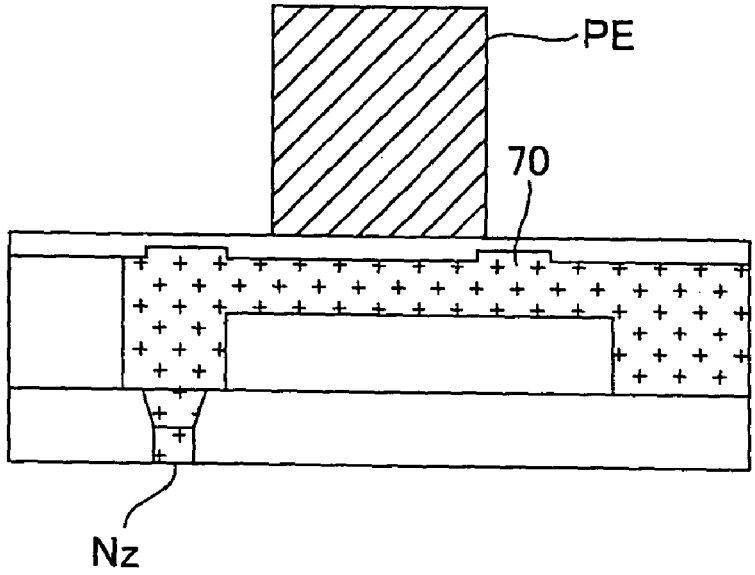
FIG. 4A and FIG. 4B are diagrams showing the structure of a piezo element and a nozzle in detail.
Figure 4B:
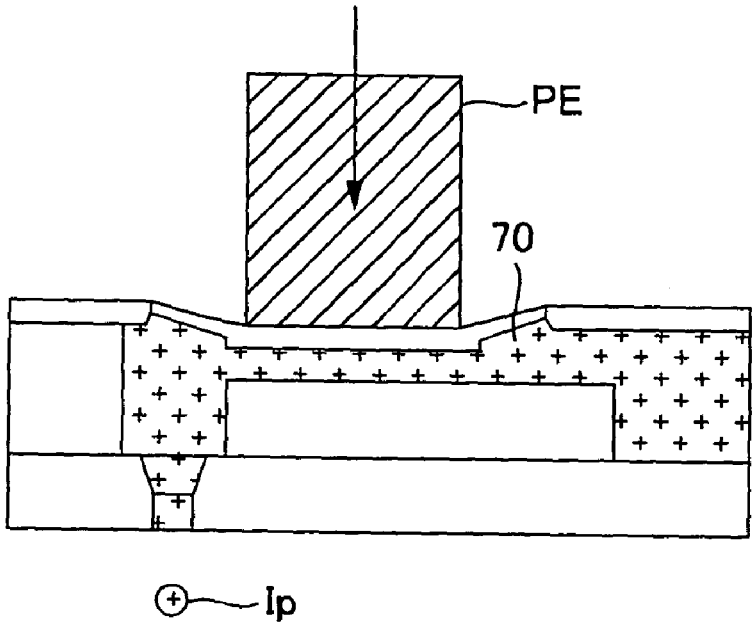

Next, the configuration of the print head will be described with reference to FIGS. 3A, 3B, 4A, and 4B. FIG. 3A and FIG. 3B are diagrams showing a schematic configuration of the inside of the print head. FIG. 4A and FIG. 4B are diagrams showing in detail the structure of a piezo element PE and a nozzle Nz.

Onto the carriage 31 (see FIG. 1) are mounted, in an attachable/detachable manner, ink cartridges 71 through 77 each respectively containing inks of seven colors, that is, black (K), cyan (C), light cyan (LC), magenta (M), light magenta (M), yellow (Y), and dark yellow (DY).

The print head 12 is provided at a lower section of the carriage 31. In the print head 12, nozzle rows R1, R2, R3, R4, R5, R6, R7, and R8 (which serve as the "ink ejecting sections") are provided. In each nozzle row, nozzles Nz (which serve as the "ink ejecting points") are arranged so as to form a row in the direction in which the print sheet is carried. The way in which the nozzles Nz are arranged in the print head 12 will be explained later.

At the bottom of the carriage 31, introduction conduits 69 (see FIG. 3A) for guiding ink from each of the ink cartridges to the print head for printing in each color are provided. When an ink cartridge 71 through 77 is mounted onto the carriage 31, the introduction conduit 69 is inserted into a connection hole provided in each ink cartridge 71 through 77, and in this way, ink can be supplied from each ink cartridge 71 through 77 to each nozzle Nz.

When an ink cartridge 71 through 77 is mounted on the carriage 31, the ink within the ink cartridge is sucked out therefrom through the introduction conduit 69 as shown in FIG. 3A and introduced to the nozzles Nz provided in the lower section of the carriage 31.

As for the nozzle rows R1 through R8 that are provided in the lower section of the carriage 31 and associated with each color, a piezo element (piezo actuator) PE, which is a type of an electrostrictive element and has a good response ability, is provided for each nozzle. As shown in FIG. 4A, the piezo element PE is arranged at a position where it contacts an ink passage 70 for guiding the ink to the nozzle Nz. As known in the art, the piezo element PE is an element that causes deformation in the crystal structure when voltage is applied and that is thereby capable of performing conversion between electrical and mechanical energy at an extremely high speed. In the present embodiment, by applying voltage between electrodes provided on both ends of the piezo element PE at predetermined time intervals, the piezo element PE expands during the period of time in which the voltage is applied as shown FIG. 4B, and thus makes the wall of the ink passage 70 on one side deform. As a result, the volume of the ink passage 70 decreases according to the expansion of the piezo element PE, and ink amounting to this volume decrease is ejected, as ink droplets Ip, at high speed from the tip of the nozzle Nz. The ink droplets Ip soak into the print sheet P that lies over the platen 26 to thereby form dots and perform printing.

===Structure of Nozzle===

Figure 5:
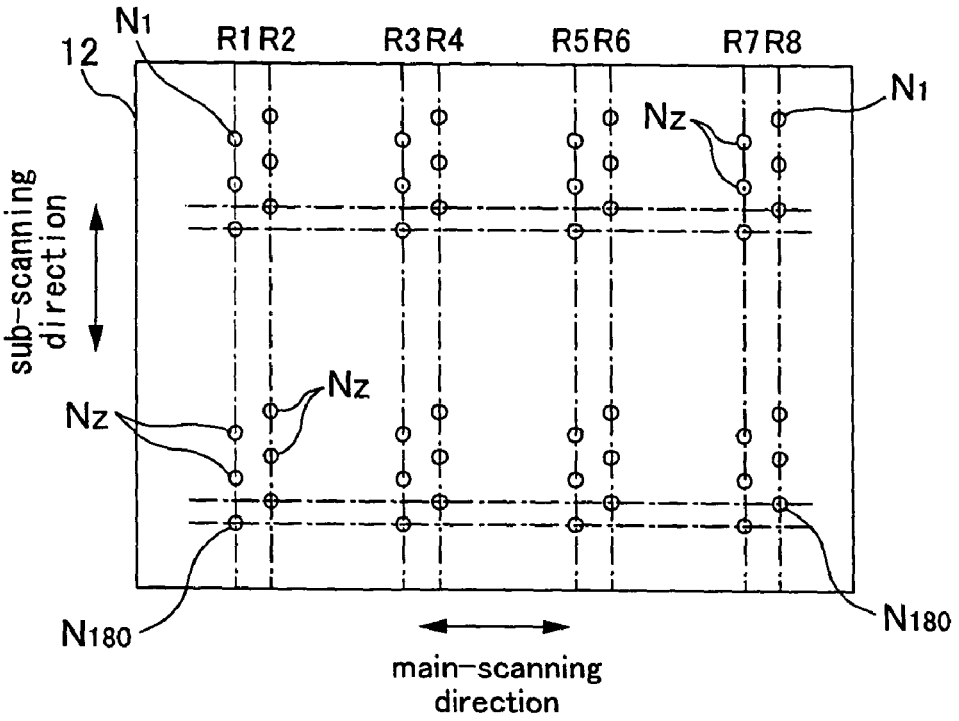
FIG. 5 is an explanatory diagram showing the arrangement of nozzles and nozzle rows in the print head.

FIG. 5 is an explanatory diagram showing the arrangement of inkjet nozzles Nz provided in the print head 12. As shown in the figure, each of the nozzle rows R1, R2, R3, R4, R5, R6, R7, R8 is formed by arranging 180 pieces of nozzles Nz in a row in the sub-scanning direction, and eight nozzle rows R1 through R8 are formed in the print head 12 arranged next to each other in the main-scanning direction. Among the eight nozzle rows R1 through R8, the nozzles Nz that belong to each of a pair of adjacent nozzle rows (for example, R1 and R2) are arranged so that their positions are shifted in the sub-scanning direction by a predetermined pitch from the nozzles in the counterpart row. Also, the nozzles Nz that belong to each of a pair of alternate nozzle rows (for example, R1 and R3) are arranged in the same positions in the sub-scanning direction.

In the print head 12 according to the present embodiment, the color of the ink that is supplied to each of the eight nozzle rows R1, R2, R3, R4, R5, R6, R7, R8 changes from dark to light from the nozzle rows R4, R5 that are located close to the center of the print head 12 in the main-scanning direction (which is perpendicular to the sub-scanning direction) towards the nozzle rows R1, R8 that are located at both ends of the print head 12.

More specifically, black-type ink is ejected from the pair of nozzle rows R4, R5 that are arrange adjacent to each other in the main-scanning direction in the central part of the print head 12; cyan-type ink is ejected from the pair of nozzle rows R3, R6, which are located adjacent to each of the nozzle rows R4, R5 in the outward direction (the direction towards both ends of the print head 12); magenta-type ink is ejected from the pair of nozzle rows R2, R7, which are located adjacent to each of the nozzle rows R3, R6 in the outward direction; and yellow-type ink is ejected from the pair of nozzle rows R1, R8, which are located adjacent to each of the nozzle rows R2, R7 in the outward direction. In this embodiment, the black-type ink is black ink, the cyan-type ink is cyan ink or light cyan ink, the magenta-type ink is magenta ink or light magenta ink, and the yellow-type ink is yellow ink or dark yellow ink.

The printer 22 of the present embodiment is capable of switching between a seven-color print mode (high image quality print mode), which is an example of "printing with a first number of colors", and a four-color print mode (high-speed print mode), which is an example of "printing with a second number of colors". In the seven-color print mode, as for the pair of nozzle rows R3, R6 from which cyan-type ink is to be ejected, cyan ink is ejected from one row R6 and light cyan ink is ejected from the other row R3; as for the pair of nozzle rows R2, R7 from which magenta-type ink is to be ejected, magenta ink is ejected from one row R7 and light magenta ink is ejected from the other row R2; and as for the pair of nozzle rows R1, R8 from which yellow-type ink is to be ejected, yellow ink is ejected from one row R8 and dark yellow ink is ejected from the other row R1.

On the other hand, in the four-color print mode, cyan ink is ejected from both the paired nozzle rows R3, R6 from which the cyan-type ink is to be ejected; magenta ink is ejected from both the paired nozzle rows R2, R7 from which the magenta-type ink is to be ejected; and yellow ink is ejected from both the paired nozzle rows R1, R8 from which the yellow-type ink is to be ejected.

Figure 6:
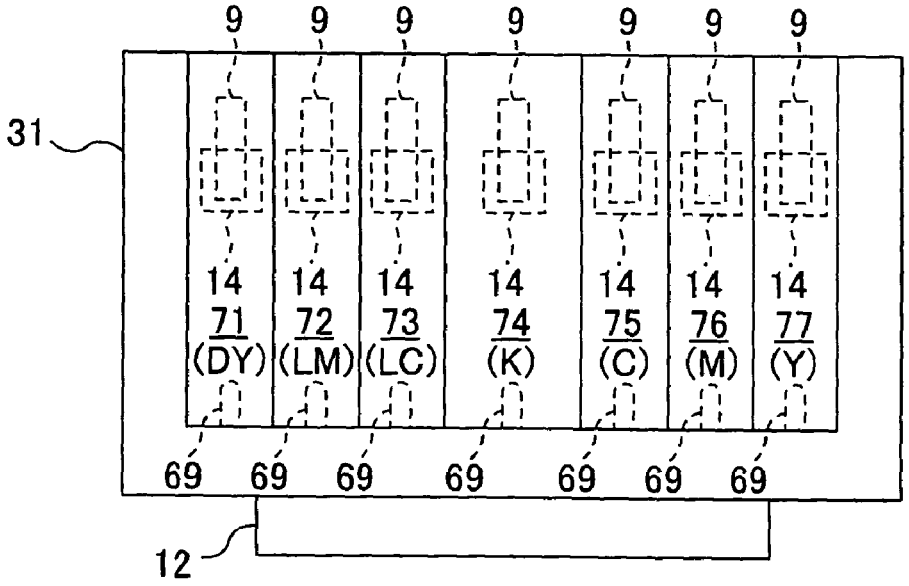
FIG. 6 is a diagram schematically showing the configuration of a carriage.

As shown in FIG. 1, in the printer 22 of the present embodiment, it is possible to detachably mount cartridges 71 through 77 onto the carriage 31. More specifically, as shown in FIG. 6, it is possible to mount the ink cartridges 71 through 77, each filled with inks of different colors that are to be ejected from each of the nozzles Nz of the print head 12, onto the carriage 31 in a manner so that each cartridge can be attached and detached independently. In the present embodiment, dark yellow ink is filled in ink cartridge 71, light magenta ink is filled in cartridge 72, light cyan ink is filled in cartridge 73, black ink is filled in cartridge 74, cyan ink is filled in cartridge 75, magenta ink is filled in cartridge 76, and yellow ink is filled in cartridge 77.

In/on the carriage 31, contact terminals 9 are provided corresponding to each of the ink cartridges 71 through 77. Each contact terminal 9 functions as means for electrically reading out various kinds of information, such as information about the type of ink filled in the cartridge, stored in a corresponding contact ROM 14 provided in or on each of the ink cartridges 71 through 77. More specifically, when one or more of the ink cartridges 71 through 77 are attached to the carriage 31, the contact ROM 14 in/on the cartridge and the contact terminal 9 are placed in contact with each other and they are brought into conduction. The information stored in the contact ROM 14 can then be read by the control circuit 40 through the contact terminal 9. The contact ROM 14 can be made by a rewritable storage element such as an EEPROM.

The control circuit 40 includes determination means that is capable of identifying the type of ink filled in each ink cartridge 71 through 77 based on the information stored in the contact ROM 14 of each cartridge 71 through 77, and determining whether or not the ink filled in each ink cartridge 71 through 77 is suitable for the designated seven-color or four color print mode. Further, the control circuit 40 is configured so that if the determination means determines that any one of the ink cartridges 71 through 77 mounted on the carriage 31 does not contain a predetermined type of ink, the user is prompted to check the ink cartridges 71 through 77 by, for example, sounding an alarm or displaying a warning screen.

The control circuit 40 may include, instead of the above-mentioned determination means or in addition to the determination means, switching means that is capable of identifying the type of ink filled in each ink cartridge 71 through 77 based on the information stored in each contact ROM 14, and switching the print mode between the seven-color mode and the four-color mode according to the type of ink filled in each ink cartridge 71 through 77. In other words, the switching means can switch the print mode between the seven-color mode and the four-color mode according to the ink type of the ink cartridges 71 through 77 attached to the carriage 31 so that an appropriate print mode is automatically selected according to the ink type of the ink cartridges 71 through 77 that have been attached.

Note that, although a printer 22 having a head that ejects ink using piezo elements PE as described above is used in this embodiment, it is possible to use elements/mechanisms other than piezo elements as ejection-activating elements. For example, the present invention can be applied to a printer having ejection-activating elements that energize heaters arranged in the ink passage and cause ink to be ejected using the bubbles formed in the ink passage. Further, the control circuit 40 may have any kind of configuration as long as it can supply drive signals to each of the ejection-activating elements and generate drive signals to keep the chronological order in which ink is ejected the same in both the forward pass and the return pass during main scanning.

===Driving the Print Head===

Figure 7:
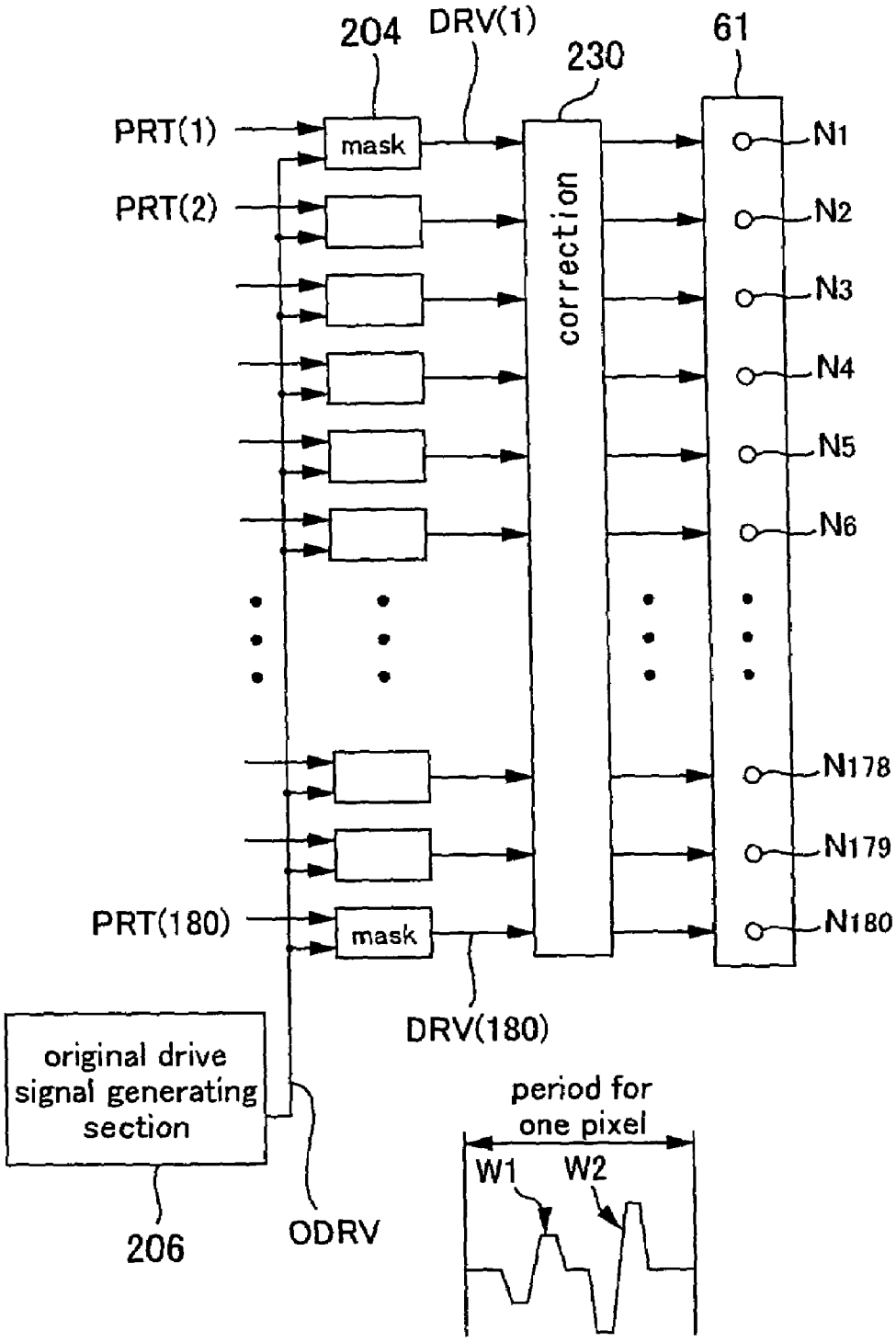
FIG. 7 is a block diagram showing the configuration of a drive signal generating section provided in a head drive circuit.

Next, the way in which the print head 12 is driven will be described below with reference to FIG. 7. FIG. 7 is a block diagram showing the configuration of a drive signal generating section provided in the drive head circuit 52 (see FIG. 2).

In FIG. 7, the drive signal generating section includes a plurality of mask circuits 204, an original drive signal generating section 206, and a drive signal correcting section 230. The mask circuits 204 are provided corresponding to each of the plurality of piezo elements for activating each of the nozzles N1 through N180 of the print head 12. Note that in FIG. 7, the number in parentheses attached to the end of each signal name indicates the number of the nozzle to which the signal is supplied. The original drive signal generating section 206 generates original drive signals ODRV used in common among the nozzles N1 through N180. The original drive signal ODRV is a signal that includes two pulses—a first pulse W1 and a second pulse W2—during the main scan period for one pixel. The drive signal correcting section 230 performs correction by shifting, either forward or backward for the whole return pass, the timing of the drive signal waveform that has been shaped by each mask circuit 204. By correcting the timing of the drive signal waveform, the misalignment (alignment error) between the positions at which the ink droplets land during the forward pass and the return pass is corrected. That is, the misalignment between the positions at which the dots are formed during the forward pass and the return pass is corrected.

As shown in FIG. 7, input serial print signals PRT(i) are input to the mask circuits 204 along with the original drive signal ODRV that has been output from the original drive signal generating section 206. The serial print signals PRT(i) are serial signals made of two bits per pixel, and each bit corresponds to the first pulse W1 and the second pulse W2, respectively.

Each mask circuit 204 is a gate for masking the original drive signal ODRV according to the level of the input serial print signal PRT(i). That is, if the serial print signal PRT(i) is at level 1, the mask circuit 204 lets the corresponding pulse of the original drive signal ODRV pass right through so that the pulse can be supplied to the piezo element as a drive signal DRV, whereas if the serial print signal PRT(i) is at level 0, the mask circuit 204 cuts off the corresponding pulse of the original drive signal ODRV.

===Overview of Correcting Misalignment between Dot-Formation Positions===

In the method of correcting the misalignment between the positions at which the dots are formed (or, the misalignment between the dot-formation positions), the timing at which the ink is ejected during the return pass is intentionally shifted for the whole return pass so that the misalignment between the positions at which the dots are formed during the forward pass and the return pass becomes inconspicuous. Note that, it is instead possible to intentionally shift, for the whole forward pass, the timing at which the ink is ejected during the forward pass, or even to intentionally shift, for both the whole forward and return passes, the timings at which the ink is ejected during both the forward pass and the return pass. Causes of the main-scanning-direction misalignment between the positions at which the dots are formed during the forward pass and the return pass may be, for example, unevenness in ink ejection speed, backlash of the main-scanning-direction drive mechanism, or a bend (warp) of the platen that supports the print sheet from below.

As mentioned above, in the seven-color print mode, the printer 22 of the present embodiment is set to eject dark yellow ink from the nozzle row R1, light magenta ink from the nozzle row R2, light cyan ink from the nozzle row R3, black ink from the nozzle rows R4, R5, cyan ink from the nozzle row R6, magenta ink from the nozzle row R7, and yellow ink from the nozzle row R8. Further, as mentioned above, by replacing the ink cartridges for supplying ink to the nozzle rows R1 through R3, it is possible to perform four-color printing. That is, in the four-color print mode, the ink cartridges are exchanged so that yellow ink is ejected from the nozzle row R1, which was used to eject dark yellow ink in the seven-color print mode, magenta ink is ejected from the nozzle row R2, which was used to eject light magenta ink, and cyan ink is ejected from the nozzle row R3, which was used to eject light cyan ink.

As for the seven-color print mode, it is preferable that the correction value therefor is able to correct the misalignment (alignment error) between the nozzle rows that eject inks of the colors in which the difference in image quality, such as the difference in color tone, between the actually-printed image and the image that should have been printed according to image data stands out the most when there is a misalignment between the dot-formation position in the forward pass and the dot-formation position in the return pass upon seven-color printing. For this reason, the correction value for the seven-color printing is determined so that it is a value for which the misalignment between the positions where ink is ejected from the nozzle rows that eject light magenta ink and light cyan ink (that is, the nozzle rows R2, R3) becomes the smallest, based on a correction pattern for the seven-color printing formed by those nozzle rows R2, R3.

On the other hand, as for the four-color printing, it is preferable that the correction value therefor is able to correct the misalignment (alignment error) between the position of the dots in the forward pass and the position of the dots in the return pass that are formed with the ink ejected from each of the two different nozzle rows that eject the ink of the same color during the four-color print mode. Therefore, the correction value for the four-color printing is determined so that it is a value for which the misalignment between the positions where ink is ejected from the nozzle rows R1, R8 (which eject yellow ink), the nozzle rows R2, R7 (which eject magenta ink), the nozzle rows R3, R6 (which eject cyan ink), and/or the nozzle rows R4, R5 (which eject black ink) becomes the smallest, based on a correction pattern formed by the ink ejected from each of relevant nozzle rows. In the present embodiment, the misalignment between the positions where ink is ejected from the nozzle rows R2, R7, which eject magenta ink, is to be corrected. These nozzle rows R2, R7 are to be used in this embodiment because the misalignment between the ink-ejection positions thereof tends to stand out the most and the distance between those nozzle rows R2, R7 is large.

===Specific Example of Correction Pattern===

Figure 8:
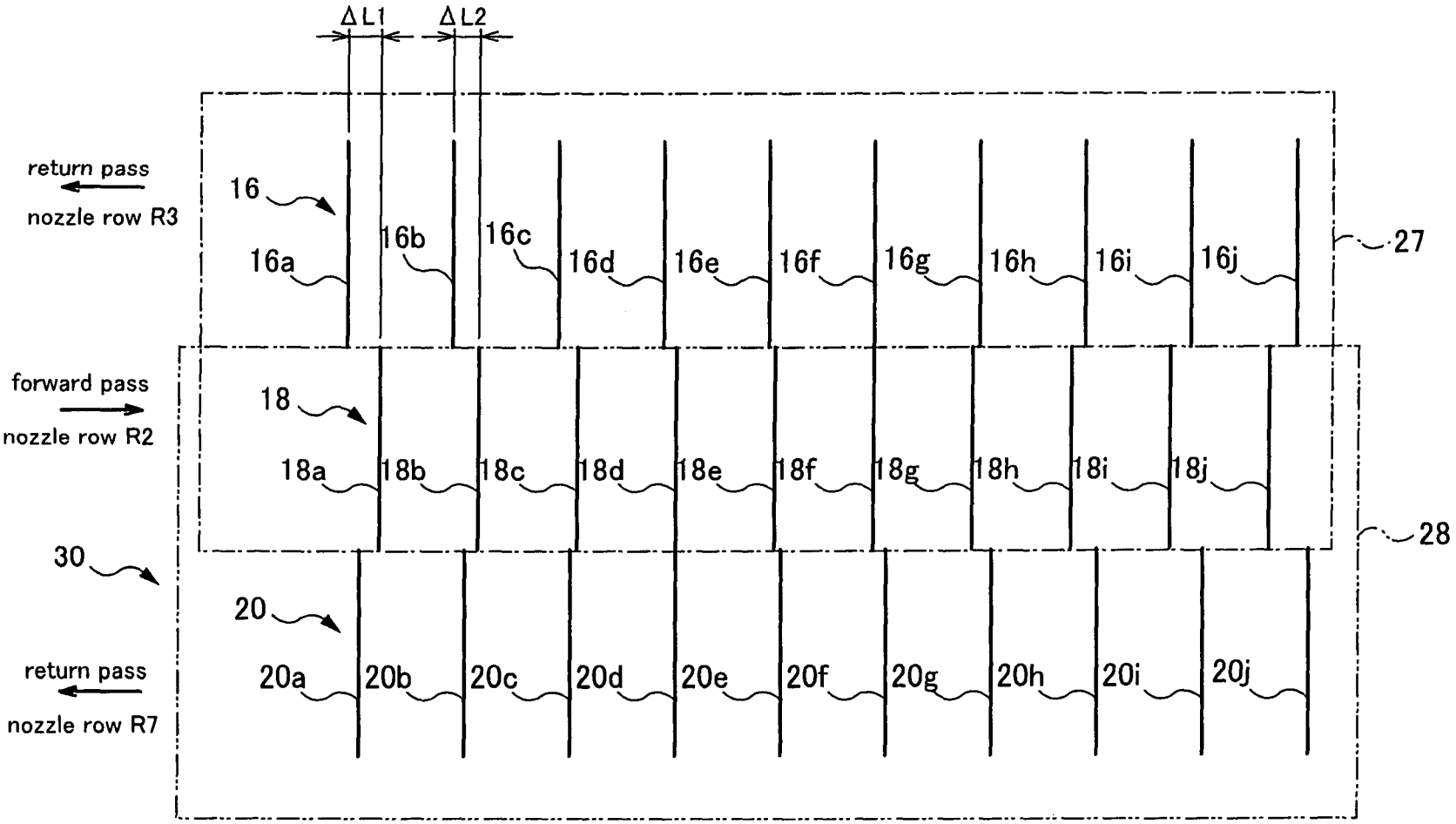
FIG. 8 is a conceptual diagram of a printed correction pattern.

Next, with reference to FIG. 8, an overview of a correction pattern for determining the correction value for chromatic colors and the correction value for achromatic colors will be described. FIG. 8 is a conceptual diagram of a printed correction pattern.

As shown in the figure, the correction pattern 30 is formed in the sub-scanning direction, and consists of a first sub-pattern 18, a second sub-pattern 16, and a third sub-pattern 20. Each sub-pattern includes ten vertical lines that extend in the sub-scanning direction and that are arranged next to each other in the main-scanning direction with appropriate spacings therebetween.

The first sub-pattern 18 is formed by ejecting ink from the nozzle row R2. This nozzle row R2 is the nozzle row common among the nozzle rows (rows R2, R3 in the present embodiment) for which misalignment should be corrected for the seven-color printing and the nozzle rows (rows R2, R7 in the present embodiment) for which misalignment should be corrected for the four-color printing. In forming the first sub-pattern 18, among the 180 nozzles included in the nozzle row R2, ink is ejected from the nozzles located in the central region in the sub-scanning direction, for example, from the nozzles N61 through N120 that are the one third located in the central region. In this case, the other nozzles are masked.

The second sub-pattern 16 is formed by ejecting either ink from the nozzle row R3 or the nozzle row R7. The nozzle row R3 and the nozzle row R7 are the nozzle rows that are not common among the nozzle rows (rows R2, R3 in the present embodiment) for which misalignment should be corrected for the seven-color printing and the nozzle rows (rows R2, R7 in the present embodiment) for which misalignment should be corrected for the four-color printing. In the present embodiment, the second sub-pattern 16 is formed by ejecting ink from the nozzle row R3. In forming the second sub-pattern 16, among the 180 nozzles included in the nozzle row R3, ink is ejected from the nozzles located in a downstream region in the sub-scanning direction (i.e., the paper-carrying direction), for example, from the nozzles N1 through N60 that are the one third located in the downstream section. In this case, the other nozzles are masked.

The third sub-pattern 20 is formed by ejecting ink from the nozzle row, among the nozzle row R3 or the nozzle row R7, that was not used for forming the second sub-pattern 16. As mentioned above, the nozzle row R3 and the nozzle row R7 are the nozzle rows that are not common among the nozzle rows (rows R2, R3 in the present embodiment) for which misalignment should be corrected for the seven-color printing and the nozzle rows (rows R2, R7 in the present embodiment) for which misalignment should be corrected for the four-color printing. In the present embodiment, the third sub-pattern 20 is formed by ejecting ink from the nozzle row R7. In forming the third sub-pattern 20, among the 180 nozzles included in the nozzle row R7, ink is ejected from the nozzles located in an upstream region in the sub-scanning direction (i.e., the paper-carrying direction), for example, from the nozzles N121 through N180 that are the one third located in the upstream section. In this case, the other nozzles are masked.

The first sub-pattern 18 is formed during the forward pass, in the main-scanning direction, of the print head 12 by ejecting ink from the nozzle row R2 to form ten vertical lines 18*a* through 18*j* on the print sheet P at a regular interval (for example, at every ½ inch). The second and third sub-patterns 16, 20 are formed during the return pass by ejecting ink from each of the nozzle rows R3 and R7 to each form ten vertical lines 16*a* through 16*j* and 20*a* through 20*j* at a regular interval similar to that of the first sub-pattern 18. In each of the second and third sub-patterns 16, 20, however, the ink-ejection timing for printing each line is varied, and the lines are printed in a row in a manner that the amount for which the ejection timing is varied (the "ejection timing variation amount") sequentially changes in the main-scanning direction. Further, the ejection timing variation amount is set so that the misalignment amount (i.e., the distance) between the dots in the forward pass and the dots in the return pass is varied by a unit correction amount that is tentatively set for selecting a suitable correction amount. The unit correction amount is set to be, for example, a distance obtained by dividing the distance between two nozzles (=1/180 inch) by, for example, eight; in other words, the unit correction amount can be (1/180 inch)÷8=1/1440 inch. In this case, the second and third sub-patterns 16, 20 are formed by shifting the ejection timings during the return pass so that each line included in each sub-pattern is shifted by 1/1440 inch in the main-scanning direction.

For example, as for the first sub-pattern 18 and the second sub-pattern 16 in FIG. 8, the difference between the distance ΔL1 between line 18*a* and line 16*a* and the distance ΔL2 between line 18*b* and line 16*b* is |ΔL1−ΔL2|=1/1440 inch.

More specifically, in the correction pattern 30 formed by the first through third sub-patterns 16, 18, 20 of the present embodiment, the second sub-pattern 16 and the third sub-pattern 20 are formed upstream and downstream, in the sheet-carrying direction, of the first sub-pattern 18 so as to sandwich the first sub-pattern 18. The sub-pattern pair consisting of the first sub-pattern 18 and the second sub-pattern 16 becomes the correction pattern 27 for seven-color printing for determining the correction value suitable for the seven-color print mode, whereas the sub-pattern pair consisting of the first sub-pattern 18 and the third sub-pattern 20 becomes the correction pattern 28 for four-color printing for determining the correction value suitable for the four-color print mode. In this way, the correction pattern 30 including both the correction pattern 27 for seven-color printing and the correction pattern 28 for four-color printing is printed in one forward and return movement of the print head 12.

Here, the correction amount for the pair of lines that consists of a line in the second sub-pattern 16 and a line in the first sub-pattern 18 (in which sub-patterns 16, 18 constitute the correction pattern 27 for seven-color printing) and that has the smallest misalignment amount becomes the correction amount suitable for the seven-color printing. In the example of FIG. 8, the misalignment amount between line 18*f* and line 16*f* is the smallest, and therefore, the correction amount adopted for printing line 16*f* becomes the appropriate correction amount.

On the other hand, the correction amount for the pair of lines that consists of a line in the third sub-pattern 20 and a line in the first sub-pattern 18 (in which sub-patterns 20, 18 constitute the correction pattern 28 for four-color printing) and that has the smallest misalignment amount becomes the correction amount suitable for the four-color printing. In the example of FIG. 8, the misalignment amount between line 18*d* and line 20*d* is the smallest, and therefore, the correction amount adopted for printing line 20*d* becomes the appropriate correction amount.

Each correction value corresponding to each of these correction amounts is stored in the EEPROM 46. When printing is performed in the seven-color print mode, the correction value suiting this seven-color print mode is used, and when printing is performed in the four-color print mode, the correction value suiting this four-color print mode is used.

In the embodiment described above, some of the configurations and functions provided by hardware may instead be realized by software, and conversely, some of the configurations and functions provided by software may instead be realized by hardware.

===Other Embodiments===

Above, an apparatus for forming a correction pattern and so on according to the present invention were described based on an embodiment thereof. However, the above-mentioned embodiment of the invention was given merely for facilitating understanding of the present invention and is not to limit the scope of the present invention. It is without saying that the present invention may be altered and/or modified without departing from the spirit thereof, and that equivalents of the present invention are encompassed within its scope.

In the embodiment mentioned above, the printer 22 has been configured to be able to switch between a seven-color print mode (high image quality print mode), which is an example of "printing with a first number of colors", and a four-color print mode (high-speed print mode), which is an example of "printing with a second number of colors". It is, however, possible for the printer to switch between a mode for "printing with a first arrangement" for printing using inks arranged according to a first arrangement, and a mode for "printing with a second arrangement" for printing using inks arranged according to a second arrangement, instead of changing the number of colors.

For example, the printer may be set so that, during the printing with the first arrangement, black ink (B) is ejected from the nozzle rows R1 through R5, cyan ink (C) is ejected from nozzle row R6, magenta ink (M) is ejected from nozzle row R7, and yellow ink (Y) is ejected from nozzle row R8. On the other hand, during the printing with the second arrangement, printing may be performed, for example, by exchanging some of the ink cartridges so that yellow ink is ejected also from the nozzle row R1, which was used to eject black ink during the printing with the first arrangement, magenta ink is ejected also from the nozzle row R2, which was used to eject black ink, and cyan ink also from the nozzle row R3, which was used to eject black ink. That is, ink may be supplied to each of the nozzle rows in a manner that: during the printing with the first arrangement, ink is supplied to each of the nozzle rows according to an arrangement of "BBBBBCMY", in the order of from nozzle row R1 to nozzle row R8; whereas during the printing with the second arrangement, ink is supplied to each of the nozzles according to an arrangement of "YMCBBCMY", in the order of from nozzle row R1 to nozzle row R8, without changing the number of colors.

<<Configuration of Computer System Etc.>>

Next, a computer system, a computer program, and a storage medium having the computer program recorded thereon, which are examples of an embodiment according to the present invention, will be described with reference to the drawings.

Figure 9:
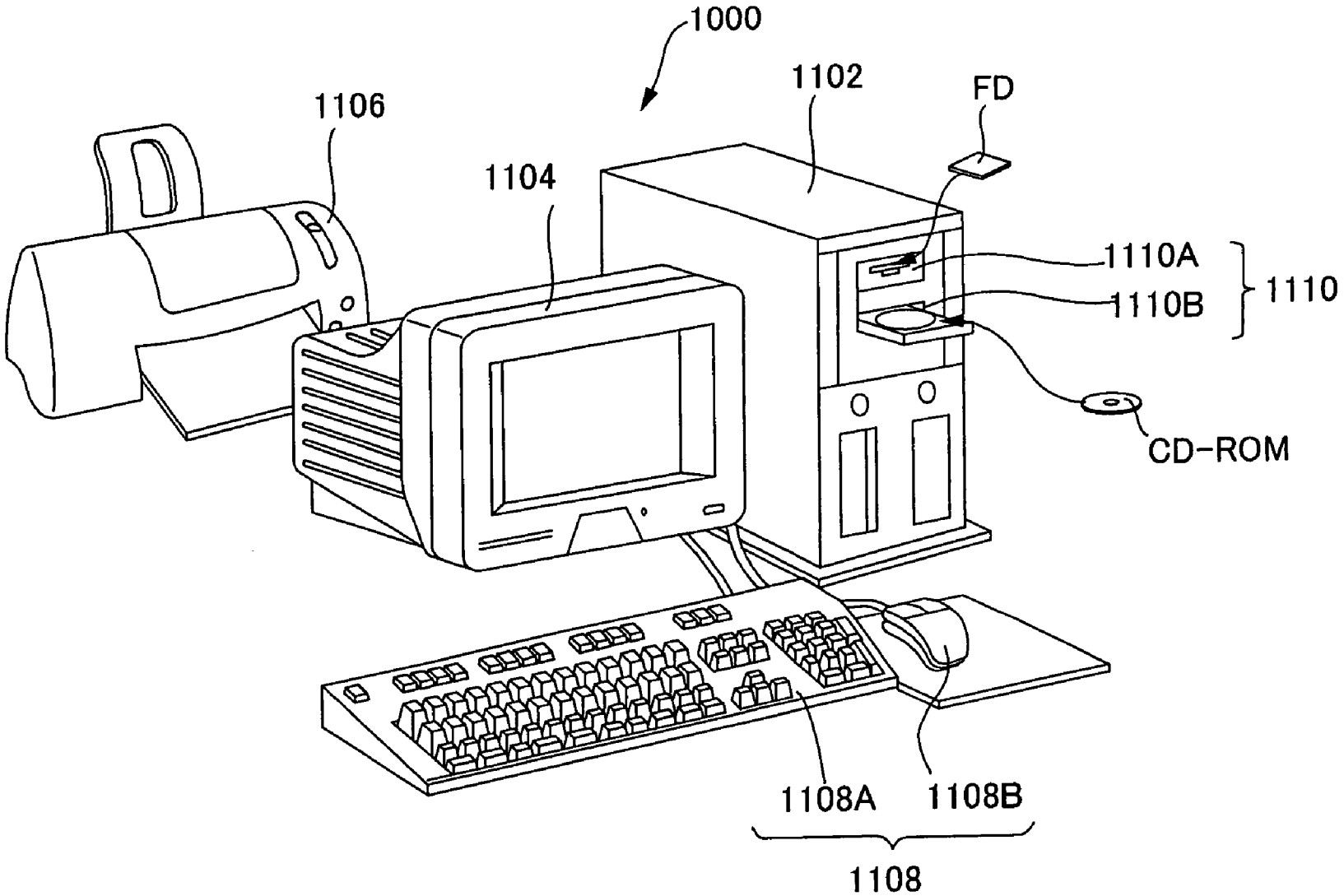
FIG. 9 is an explanatory diagram showing an external configuration of a computer system.

FIG. 9 is an explanatory diagram showing the external configuration of a computer system. The computer system 1000 includes: a computer unit 1102; a display device 1104; a printer 1106; an input device 1108; and a reading device 1110. In the present embodiment, the computer unit 1102 is housed in a mini-tower casing; however the structure is not limited to this example. Although a CRT (cathode ray tube), a plasma display, or a liquid crystal display device is generally used as the display device 1104, any other kind of device can be used. The printer explained above is used as the printer 1106. In the present embodiment, a keyboard 1108A and a mouse 1108B are used as the input device 1108; however, any other kind of device can be used. In the present embodiment, a flexible disk drive device 1110A and a CD-ROM drive device 1110B are used as the reading device 1110; however, it is also possible to use an MO (magneto-optical) disk drive device, a DVD (digital versatile disk) drive, or any other kind of device.

Figure 10:
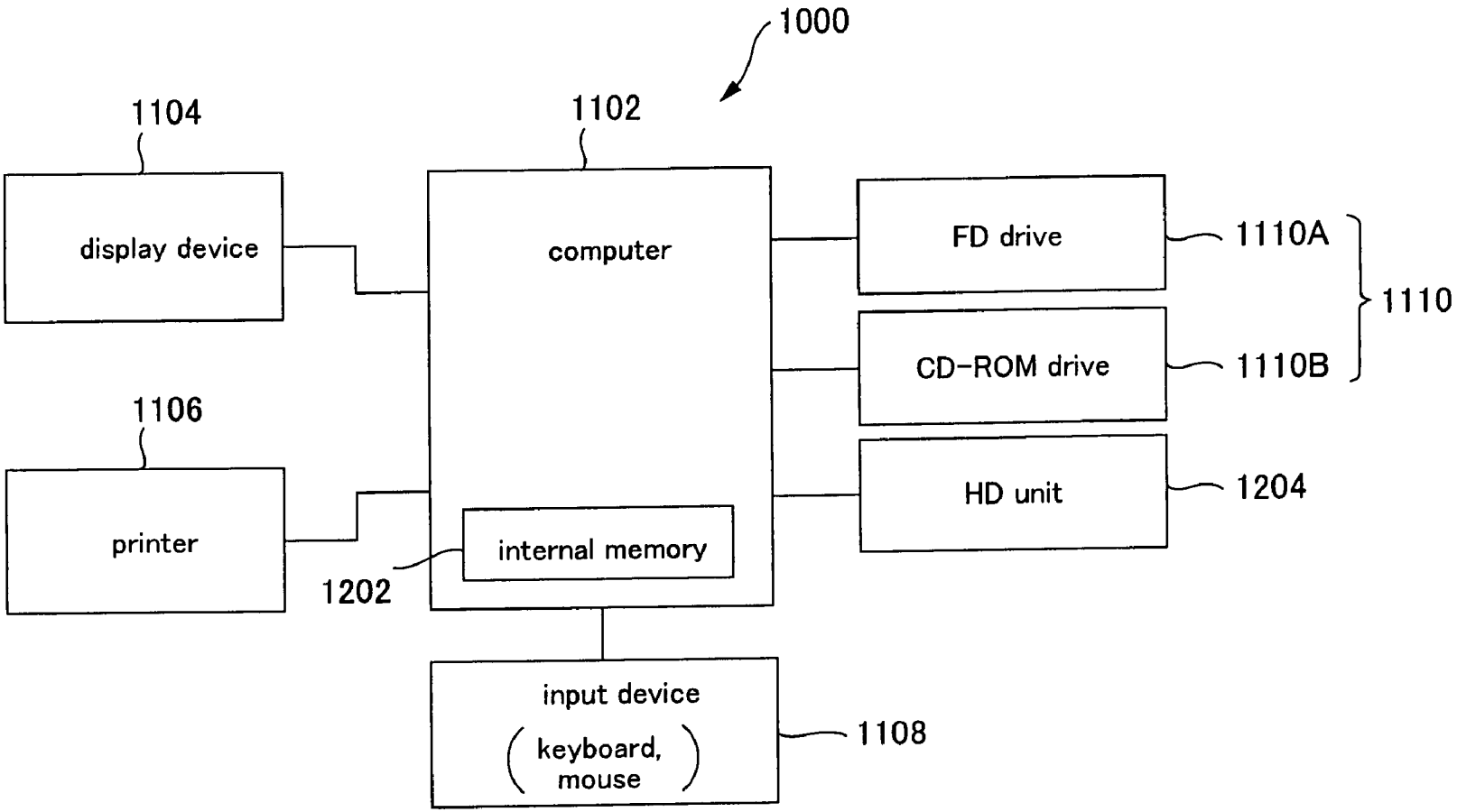
FIG. 10 is a block diagram showing the configuration of the computer system shown in FIG. 9.

FIG. 10 is a block diagram showing the configuration of the computer system shown in FIG. 9. FIG. 10 shows that an internal memory 1202, such as a RAM (random access memory), provided inside the casing in which the computer unit 1102 is housed, and an external memory, such as a hard-disk drive unit 1204, are also provided.

In the above, description was made of an example in which the printer 1106 is connected to the computer unit

1102, the display device 1104, the input device 1108, and the reading device 1110 to configure the computer system. However, the configuration is not limited to the above. For example, the computer system may be configured comprising only the computer unit 1102 and the printer 1106, and it does not have to comprise the display device 1104, the input device 1108, and the reading device 1110.

Further, for example, it is also possible for the printer 1106 to have some of the functions or mechanisms of each of the computer unit 1102, the display device 1104, the input devices 1108, and the reading device 1110. For example, it is possible to structure the printer 1106 so that it comprises an image processor for image processing, a display section for performing various kinds of displaying, and a recording media mounting section for detachably mounting a recording medium on which image data captured with a digital camera or the like is stored.

A computer system configured as above will be superior to existing computer systems as a whole.

According to the present invention, it is possible to provide a printing method for forming a correction pattern for printing with a first arrangement (a first number of colors) and a correction pattern for printing with a second arrangement (a second number of colors) both at once, a printing apparatus, a correction pattern to be used for the correction, and a computer-readable medium having a program recorded thereon for making a printing apparatus realize a function of printing the correction pattern.

What is claimed is:

1. A printing method comprising:

ejecting ink from ink ejecting sections provided in/on a movable print head to form dots;

performing at least either printing with a first arrangement using inks arranged according to said first arrangement or printing with a second arrangement using inks arranged according to said second arrangement by changing the arrangement of inks supplied to each of said ink ejecting sections; and printing, with one forward and return movement of said print head, a correction pattern for determining a correction amount to be used for said printing with the first arrangement for correcting a misalignment between a position at which dots are formed during a forward pass of said print head and a position at which dots are formed during a return pass of said print head that occurs during said printing with the first arrangement and a correction amount to be used for said printing with the second arrangement for correcting a misalignment between a position at which dots are formed during a forward pass of said print head and a position at which dots are formed during a return pass of said print head that occurs during said printing with the second arrangement.

2. A printing method according to claim 1, wherein:

inks of a first number of colors are used during said printing with the first arrangement;

inks of a second number of colors are used during said printing with the second arrangement;

at least either printing with the first number of colors using said inks of the first number of colors or printing with the second number of colors using said inks of the second number of colors is performed by changing the number of colors of inks supplied on a color-by-color basis to each of said ink ejecting sections; and a correction pattern for determining a correction amount to be used for said printing with the first number of colors for correcting a misalignment between a position at which dots are formed during a forward pass of said print head and a position at which dots are formed during a return pass of said print head that occurs during said printing with the first number of colors and a correction amount to be used for said printing with the second number of colors for correcting a misalignment between a position at which dots are formed during a forward pass of said print head and a position at which dots are formed during a return pass of said print head that occurs during said printing with the second number of colors is printed with one forward and return movement of said print head.

3. A printing method according to claim 2, wherein:

said correction pattern is printed by forming a first sub-pattern during said forward pass of said print head and a second sub-pattern and a third sub-pattern during said return pass of said print head by ejecting ink from different ones of said ink ejecting sections;

a sub-pattern pair consisting of said first sub-pattern and one of either said second sub-pattern or said third sub-pattern is taken as the correction pattern for determining said correction amount to be used for said printing with the first number of colors; and a sub-pattern pair consisting of said first sub-pattern and the other one of said second sub-pattern or said third sub-pattern is taken as the correction pattern for determining said correction amount to be used for said printing with the second number of colors.

4. A printing method according to claim 3, wherein:

each of said ink ejecting sections has ink ejecting points that are arranged in a row in a direction perpendicular to the direction of movement of said print head;

said first sub-pattern is formed during said forward pass by ejecting ink from ones of said ink ejecting points that are arranged in a central region of the one of said ink ejecting sections used for forming said first sub-pattern;

said second sub-pattern is formed during said return pass by ejecting ink from ones of said ink ejecting points that are arranged in a region on one end of the one of said ink ejecting sections used for forming said second sub-pattern; and said third sub-pattern is formed during said return pass by ejecting ink from ones of said ink ejecting points that are arranged in a region on the other end of the one of said ink ejecting sections used for forming said third sub-pattern.

5. A printing method according to claim 2, wherein:

said printing with the first number of colors is performed by printing using at least light magenta ink and light cyan ink; and said ink ejecting sections used for printing said correction pattern is an ink ejecting section used for ejecting said light magenta ink during said printing with the first number of colors and an ink ejecting section used for ejecting said light cyan ink during said printing with the first number of colors.

6. A printing method according to claim 2, wherein:

said printing with the second number of colors is performed using at least, among said ink ejecting sections, two of said ink ejecting sections for ejecting magenta ink and two of said ink ejecting sections for ejecting cyan ink; and said ink ejecting sections used for printing said correction pattern are either said two ink ejecting sections for ejecting said magenta ink or said two ink ejecting sections for ejecting said cyan ink.

7. A printing method comprising:

ejecting ink from ink ejecting sections provided in/on a movable print head to form dots;

performing at least either printing with a first number of colors using inks of said first number of colors or printing with a second number of colors using inks of said second number of colors by changing the number of colors of inks supplied on a color-by-color basis to each of said ink ejecting sections; and printing, with one forward and return movement of said print head, a correction pattern for determining a correction amount to be used for said printing with the first number of colors for correcting a misalignment between a position at which dots are formed during a forward pass of said print head and a position at which dots are formed during a return pass of said print head that occurs during said printing with the first number of colors and a correction amount to be used for said printing with the second number of colors for correcting a misalignment between a position at which dots are formed during a forward pass of said print head and a position at which dots are formed during a return pass of said print head that occurs during said printing with the second number of colors, wherein:

each of said ink ejecting sections has ink ejecting points that are arranged in a row in a direction perpendicular to the direction of movement of said print head;

said correction pattern is made of a first sub-pattern formed during said forward pass of said print head by ejecting ink from ones of said ink ejecting points that are arranged in a central region of the one of said ink ejecting sections used for forming said first sub-pattern, a second sub-pattern formed during said return pass of said print head by ejecting ink from ones of said ink ejecting points that are arranged in a region on one end of the one of said ink ejecting sections used for forming said second sub-pattern, and a third sub-pattern formed during said return pass of said print head by ejecting ink from ones of said ink ejecting points that are arranged in a region on the other end of the one of said ink ejecting sections used for forming said third sub-pattern by using different ones of said ink ejecting sections;

the correction pattern for determining said correction amount to be used for said printing with the first number of colors is a sub-pattern pair consisting of said first sub-pattern and one of either said second sub-pattern or said third sub-pattern;

the correction pattern for determining said correction amount to be used for said printing with the second number of colors is a sub-pattern pair consisting of said first sub-pattern and the other one of said second sub-pattern or said third sub-pattern;

said printing with the first number of colors is performed by printing using at least light magenta ink and light cyan ink;

said ink ejecting sections used for printing said correction pattern is an ink ejecting section used for ejecting said light magenta ink during said printing with the first number of colors and an ink ejecting section used for ejecting said light cyan ink during said printing with the first number of colors;

said printing with the second number of colors is performed using at least, among said ink ejecting sections, two of said ink ejecting sections for ejecting magenta ink and two of said ink ejecting sections for ejecting cyan ink; and said ink ejecting sections used for printing said correction pattern are either said two ink ejecting sections for ejecting said magenta ink or said two ink ejecting sections for ejecting said cyan ink.

8. A printing apparatus comprising:

a movable print head having ink ejecting sections for ejecting ink to form dots, wherein said printing apparatus:

is capable of performing at least either printing with a first arrangement using inks arranged according to said first arrangement or printing with a second arrangement using inks arranged according to said second arrangement by changing the arrangement of inks supplied to each of said ink ejecting sections; and prints, with one forward and return movement of said print head, a correction pattern for determining a correction amount to be used for said printing with the first arrangement for correcting a misalignment between a position at which dots are formed during a forward pass of said print head and a position at which dots are formed during a return pass of said print head that occurs during said printing with the first arrangement and a correction amount to be used for said printing with the second arrangement for correcting a misalignment between a position at which dots are formed during a forward pass of said print head and a position at which dots are formed during a return pass of said print head that occurs during said printing with the second arrangement.

9. A computer-readable storage medium having a program recorded thereon, said program making a printing apparatus that has a movable print head having ink ejecting sections for ejecting ink to form dots and that is capable of performing at least either printing with a first arrangement using inks arranged according to said first arrangement or printing with a second arrangement using inks arranged according to said second arrangement by changing the arrangement of inks supplied to each of said ink ejecting sections, and printing a correction pattern for determining a correction amount to be used for said printing with the first arrangement for correcting a misalignment between a position at which dots are formed during a forward pass of said print head and a position at which dots are formed during a return pass of said print head that occurs during said printing with the first arrangement and a correction amount to be used for said printing with the second arrangement for correcting a misalignment between a position at which dots are formed during a forward pass of said print head and a position at which dots are formed during a return pass of said print head that occurs during said printing with the second arrangement function to print said correction pattern with one forward and return movement of said print head.

10. A correction pattern for use with a printing apparatus, said printing apparatus being capable of performing at least either printing with a first arrangement using inks arranged according to said first arrangement or printing with a second arrangement using inks arranged according to said second arrangement by changing the arrangement of inks supplied to each of a plurality of ink ejecting sections provided in/on a movable print head and for ejecting ink to form dots, each of said ink ejecting sections having ink ejecting points that are arranged in a row in a direction perpendicular to the direction of movement of said print head, said correction pattern being used for determining a correction amount to be used for said printing with the first arrangement for correcting a misalignment between a position at which dots are formed during a forward pass of said print head and a position at which dots are formed during a return pass of said print head that occurs during said printing with the first arrangement and a correction amount to be used for said printing with the second arrangement for correcting a misalignment between a position at which dots are formed during a forward pass of said print head and a position at which dots are formed during a return pass of said print head that occurs during said printing with the second arrangement, said correction pattern comprising:

a first sub-pattern formed during said forward pass of said print head and a second sub-pattern and a third sub-pattern formed during said return pass of said print head, wherein:

said correction amount to be used for said printing with the first arrangement is determined based on a sub-pattern pair consisting of said first sub-pattern and one of either said second sub-pattern or said third sub-pattern; and said correction amount to be used for said printing with the second arrangement is determined based on a sub-pattern pair consisting of said first sub-pattern and the other one of said second sub-pattern or said third sub-pattern.

* * * * *